US006749276B2

(12) United States Patent
Judge et al.

(10) Patent No.: US 6,749,276 B2
(45) Date of Patent: Jun. 15, 2004

(54) SEQUENCING MECHANISM FOR SLIDE ASSEMBLY

(75) Inventors: Ronald J. Judge, Corona, CA (US); Patty J. Brock, Irvine, CA (US); Bao Q. Nguyen, Garden Grove, CA (US)

(73) Assignee: Jonathan Manufacturing Corp., Irvine, CA (US)

( * ) Notice: Subject to any disclaimer, the term of this patent is extended or adjusted under 35 U.S.C. 154(b) by 40 days.

(21) Appl. No.: 10/262,637

(22) Filed: Oct. 1, 2002

(65) Prior Publication Data

US 2003/0080659 A1 May 1, 2003

Related U.S. Application Data

(60) Provisional application No. 60/327,331, filed on Oct. 1, 2001.

(51) Int. Cl.[7] ..... A47B 88/04

(52) U.S. Cl. ..... 312/334.47; 312/334.44; 312/334.11

(58) Field of Search ..... 312/330.1, 334.1, 312/333, 334.7, 334.8, 334.11, 334.17, 334.44, 334.46, 334.47; 384/18, 21, 22

(56) References Cited

U.S. PATENT DOCUMENTS 3,141,714 A * 7/1964 Valitus ..... 312/334.46
3,937,531 A * 2/1976 Hagen et al. ..... 384/18
4,549,773 A * 10/1985 Papp et al. ..... 384/18
4,560,212 A * 12/1985 Papp et al. ..... 384/18
5,551,775 A 9/1996 Parvin
6,209,979 B1 * 4/2001 Fall et al. ..... 312/330.1
6,350,001 B1 * 2/2002 Chu ..... 312/334.44

FOREIGN PATENT DOCUMENTS

GB 341745 * 1/1931 ..... 312/334.47

* cited by examiner

*Primary Examiner*—James O. Hansen
(74) *Attorney, Agent, or Firm*—Knobbe, Martens, Olson & Bear LLP

(57) ABSTRACT

A sequencing mechanism for a slide assembly having at least three segments, including an outer slide segment, one or more intermediate slide segments and an inner slide segment. The sequencing mechanism ensures that the inner and intermediate slide segments extend together, from a substantially retracted position, until the intermediate segment reaches substantially full extension. The sequencing mechanism includes a sequence latch pivotally attached to the intermediate slide segment and configured to operate in both an upright orientation and an inverted orientation of the slide assembly. The latch has a hook portion at one end and a transversely extending tab portion at the opposing end. The hook portion selectively engages an opening in the inner slide segment to lock the inner slide segment to the intermediate slide segment. An actuator is connected to, or formed from, the outer slide segment and is configured to engage the tab portion of the latch to unlock the inner slide segment from the intermediate slide segment. In addition, the actuator engages the tab portion of the latch to lock the intermediate slide segment in a fully extended position. Upon retraction of the slide assembly, the inner segment engages the hook portion to rotate the latch from engagement with the actuator and unlock the intermediate segment from its fully extended position.

15 Claims, 8 Drawing Sheets

SEQUENCING MECHANISM FOR SLIDE ASSEMBLY

RELATED APPLICATIONS

This application is related to, and claims priority from, U.S. Provisional Patent Application No. 60/327,331, filed Oct. 1, 2001, the entirety of which is incorporated by reference herein.

BACKGROUND OF THE INVENTION

1. Field of the Invention

The present invention relates generally to a slide assembly and more specifically to a mechanism for determining the sequence in which the individual members of the slide assembly extend and/or retract upon opening or closing of the slide assembly.

2. Description of the Related Art

Slide assemblies are typically mounted on opposing sides of a movable object, such as a drawer, to allow the object to be extended from within a cabinet, or other support structure, in order to be accessible. There are two common types of slide assemblies. The first type includes two segments which slide with respect to one another, one being fixed to the enclosure and the other fixed to the movable object. The maximum extension of a two segment slide is necessarily less than the length of either segment, in order to maintain engagement between the two segments.

The other common type of slide includes at least one intermediate segment, which is in sliding engagement with both the object-mounted slide segment and the enclosure-mounted slide segment. In a three segment slide, an outer segment is affixed to the enclosure, an intermediate segment slides with respect to the outer segment, and an inner segment slides with respect to the intermediate segment and is fixed to the movable object. Thus, the intermediate segment is detached from both the surrounding cabinet and drawer, or other object.

The additional slide segment in a three segment slide creates a stronger, stiffer slide assembly in comparison with a two segment slide. Furthermore, in some arrangements, the inner slide segment can be extended from within the outer slide segment at least its entire length. This type of slide assembly is commonly referred to as an "over-travel" slide. Thus, by utilizing an over-travel slide assembly, the movable object may be completely withdrawn from the enclosure.

To avoid damage to the slide assembly, it is desirable that first the intermediate slide extends with respect to the outer segment and then the inner segment completes the full extension of the slide. Many sequenced slide assemblies rely on an arrangement which induces friction between the inner slide segment and the intermediate slide segment so that the inner and intermediate slide segments extend together until the intermediate segment reaches full extension. However, when the slide assembly is carrying a load, extraneous sources of friction between the outer slide segment and the intermediate slide segment may overcome the intended, sequencing friction and allow the inner slide segment to extend before the intermediate segment. Thus, in an actual use environment, such friction slide assemblies often fail to provide reliable sequencing action.

Other sequencing arrangements utilize gravity-assisted latch mechanisms, which pivot under the influence of gravity to lock two of the slide segments together. However, because these types of sequencing arrangements rely on gravity, they are not effective when the slide assembly is inverted. Accordingly, a single slide design cannot be used to support both sides of an object, as the slide assemblies have to be inverted relative to one another so that the outer slide segments face the enclosure and the inner slide segments face the supported object. If a gravity-assisted latch mechanism is used, right-hand side specific and left-hand side specific slide segments must be provided, which are typically mirror images of one another. This results in increased manufacturing costs and requires pairing of right-hand slides with left-hand slides. Therefore, given the drawbacks of the prior art, a need exists for an improved slide sequencing assembly.

Another example of a prior latch mechanism is illustrated in FIG. 1 and described in greater detail in U.S. Pat. No. 5,551,775 to Parvin. The slide assembly 1 of Parvin includes an inner slide segment 1*a,* an intermediate slide segment 1*b* and an outer slide segment 1*c* telescopingly engaged with one another, as is well known in the art. A latch member 2 is pivotally connected to the intermediate slide segment 1*b* to pivot about an axis 3. A spring arm 2*a* extends from a forward end of the latch member 2 and is capable of flexing with respect to the main body portion 2*b* of the latch member 2. A tab 4 is affixed to the inner slide segment 1*a* and may be configured to contact the spring arm 2*a* when the inner slide segment 1*a* is fully retracted with respect to the intermediate slide segment 1*b*. Accordingly, the latch member 2 is rotated about the pivot axis 3 such that a corner 2*c* of the latch 2 engages an opening 5 in the inner slide segment 1*a*. Due to the interference between the corner 2*c* and the opening 5, extension of the inner slide segment 1*a* results in extension of the intermediate slide segment 1*b*.

The latch 2 also includes a perpendicular tab 2*d* that extends through a window 6 in the intermediate slide segment 1*b*. When the intermediate slide segment 1*b* nears a fully extended position, the tab 2*d* engages an actuator (not shown) on the outer slide segment 1*c*. The actuator has a ramped contact surface that lifts the tab 2*d* as the latch 2 moves along the actuator (i.e., as the inner 1*a* and intermediate 1*b* slide segments are extended). As a result, the latch 2 is rotated such that the corner 2*c* is disengaged from the opening 5 and the inner slide segment 1*a* is free to extend relative to the intermediate slide segment 1*b*.

The Parvin reference states that this structure permits the latch 2 to couple the inner slide segment 1*a* and the intermediate slide segment 1*b* for extension without the assistance of gravity, due to the interaction between the tab 4 and the spring arm 2*a*. As a result, the slide assembly 1 may be inverted such that a single slide design may be used to mount both the right-hand and left-hand side of a drawer, or other object. However, the Parvin slide assembly 1 relies on the relative positioning of the inner 1*a* and intermediate 1*b* slide segments to achieve this result. Accordingly, once the inner slide segment 1*a* is extended, even slightly, relative to the intermediate slide segment 1*b,* the latch 1 is subject to rotation due to gravity. As a result, the latch 1 cannot be used for other sequencing functions, such as locking the intermediate segment 1*b* in an extended position, in both an upright and inverted orientation. Furthermore, as is described in greater detail below, the latch 1 relies on precise positioning of the tab 4 of the inner slide segment 1*a*. As a result, manufacturing of the slide assembly becomes more costly. Accordingly, a need exists for a slide sequencing arrangement that provides reliable operation in both an upright and an inverted position, and does not rely on relative positioning of the individual slide segments to assume an operational position.

SUMMARY OF THE INVENTION

Accordingly, preferred embodiments provide an improved slide sequencing arrangement particularly adapted to use a minimum of parts for inexpensive manufacture and assembly. Advantageously, the assembly is particularly adapted for use in three member slides wherein the inner segment is only slideable once the middle segment has been fully extended, thereby minimizing damage to the slide assembly. The preferred arrangement also locks the intermediate segment in its fully extended position until the inner slide segment is substantially completely retracted with respect to the intermediate slide segment upon closing of the slide assembly. Preferably, the sequencing assembly is operational, independent of gravity, despite the relative positions of the individual slide members. Further, the assembly is preferably adapted to achieve these advantages within a relatively narrow cross-sectional envelope.

A preferred embodiment is a slide assembly including an outer slide segment, an intermediate slide segment and an inner slide segment. The intermediate slide segment is telescopingly engaged with the outer slide segment and is moveable between a retracted position and an extended position with respect to the outer slide segment. The inner slide segment is telescopingly engaged with the intermediate slide segment and is moveable between a retracted position and an extended position with respect to the intermediate slide segment. A sequencing latch is pivotally connected to the intermediate slide segment. A spring member has a first end and a second end and is configure to exert opposing forces from the first and second ends. The first end of the spring member acts on the intermediate slide segment and the second end of the spring member acts on the latch. Thereby, the latch is biased into mechanical engagement with the inner slide segment to lock the inner slide segment substantially in the retracted position with respect to the intermediate slide segment when the intermediate slide segment is in the retracted position. An actuator is fixed with respect to the outer slide segment and includes a ramp surface being configured to engage the latch when the intermediate slide segment is substantially in the extended position. Further extension of the intermediate segment causes the latch to rotate and release the inner slide segment from the retracted position.

A preferred embodiment is a slide assembly including an outer slide segment, and intermediate slide segment and an inner slide segment. The intermediate slide segment is telescopingly engaged with the outer slide segment and is moveable between a retracted position and an extended position with respect to the outer slide segment. An inner slide segment is telescopingly engaged with the intermediate slide segment and is moveable between a retracted position and an extended position with respect to the intermediate slide segment. A sequencing latch connected to the intermediate slide segment. The latch has a first end defining a retaining surface and a release surface. The retaining surface being configured to lock the inner slide segment substantially in the retracted position with respect to the intermediate slide segment when the intermediate slide segment is in the retracted position. An actuator is fixed with respect to the outer slide segment and is configured to engage the latch to release the inner slide segment from the retracted position when the intermediate slide segment is substantially in the extended position. The actuator additionally comprises a stop surface, the latch being configured to engage the stop surface to secure the intermediate slide segment into the extended position. A portion of the inner slide segment is configured to engage the release surface of the latch during retraction of the inner slide segment to bias the latch out of engagement with the stop surface and thereby permit retraction of the intermediate slide segment.

A preferred embodiment is a slide assembly including an outer slide segment, an intermediate slide segment and an inner slide segment. The intermediate slide segment is telescopingly engaged with the outer slide segment and is moveable between a retracted position and an extended position with respect to the outer slide segment. The inner slide segment has at least one transverse flange defining an opening and is telescopingly engaged with the intermediate slide segment. The inner slide segment is moveable between a retracted position and an extended position with respect to the intermediate slide segment. A sequencing latch is connected to the intermediate slide segment. A spring member is arranged to apply opposing forces on the intermediate slide segment and the latch. The spring member biases the latch within the opening to lock the inner slide segment substantially in the retracted position with respect to the intermediate slide when the intermediate slide is in the retracted position. An actuator is fixed with respect to the outer slide segment and is configured to engage the latch. Wherein further extension of the intermediate segment rotates the latch to release the inner slide segment from the retracted position when the intermediate slide segment is substantially in the extended position.

DETAILED DESCRIPTION OF THE PREFERRED EMBODIMENT

Figure 2A:
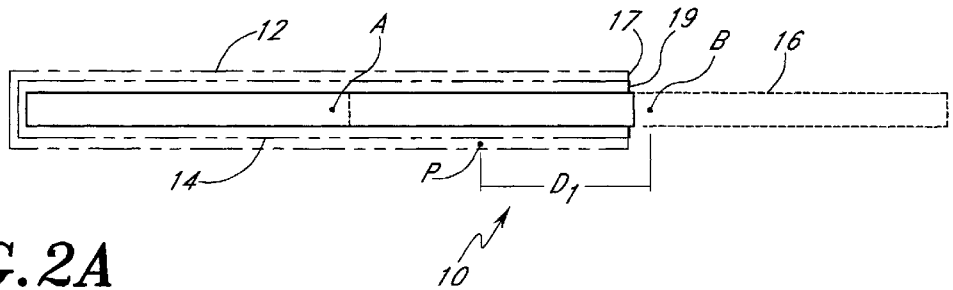
FIGS. 2*a*–2*c* are schematic views of a slide assembly illustrating the center of gravity of a load placed on a slide when the inner slide segment extends first.
Figure 8:
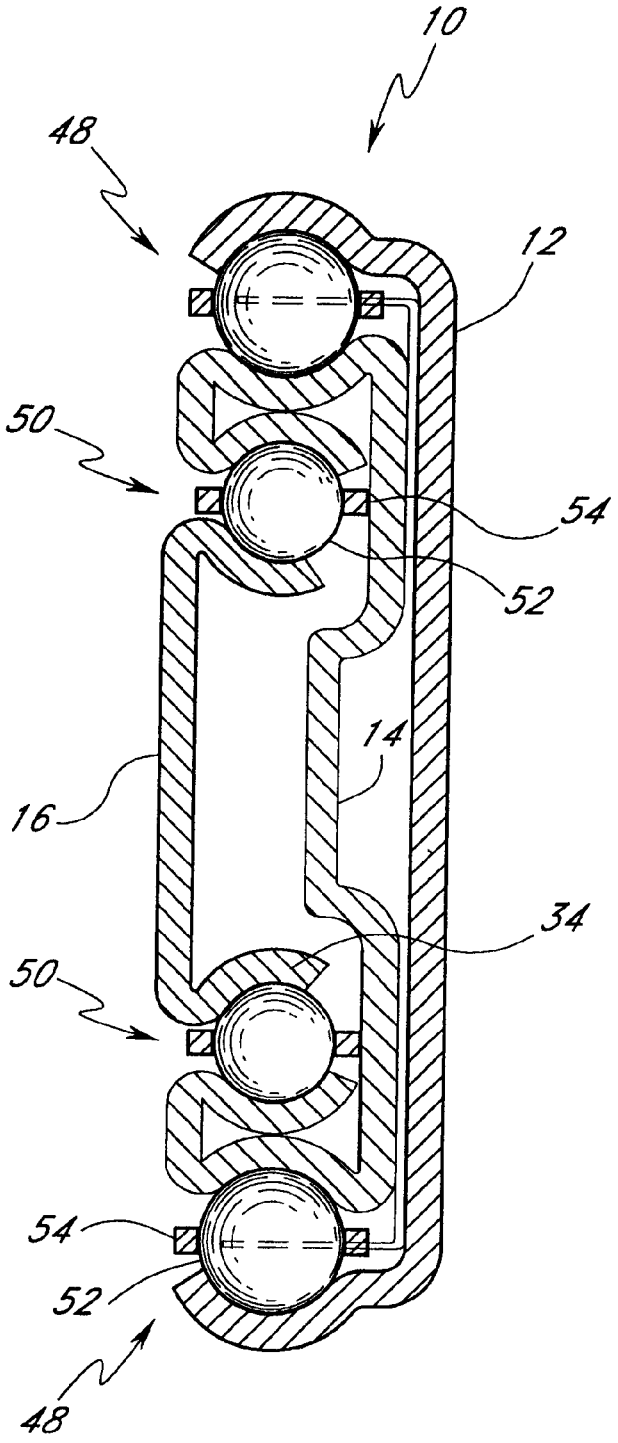
FIG. 8 is a cross-section view of the slide assembly of FIG. 4.

FIG. 2*a* is a schematic illustration of a slide assembly 10. The slide assembly 10 includes an outer slide segment 12, an intermediate slide segment 14, and an inner slide segment 16. The intermediate slide segment 14 is nested within the outer slide segment 12 and is capable of extending from an open end 17 of the outer slide segment 12. The inner slide segment 16 is nested within the intermediate slide segment 14 and is capable extending from an open end 19 of the intermediate slide segment 14. The individual slide segments 12, 14, 16 may be in direct contact, also known as a friction slide. Preferably, however, an outer bearing assembly 48 (FIG. 4) is interposed between the intermediate slide segment 14 and the outer slide segment 12 and an inner bearing assembly 50 (FIG. 4) is interposed between the inner slide segment 16 and the intermediate slide segment 14, as illustrated in FIG. 8.

Figure 2B:
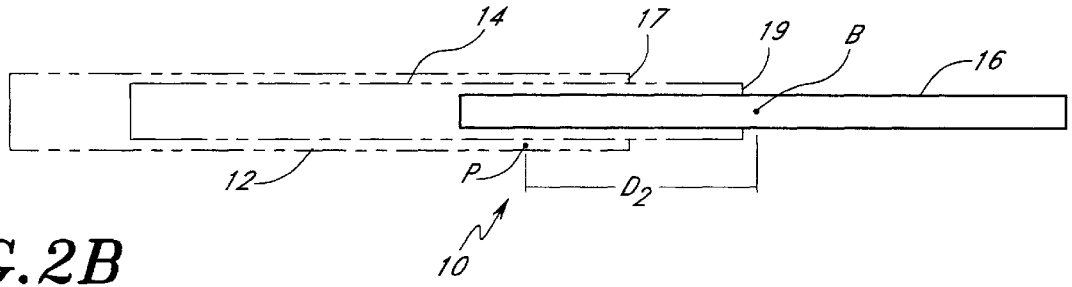
Figure 2C:
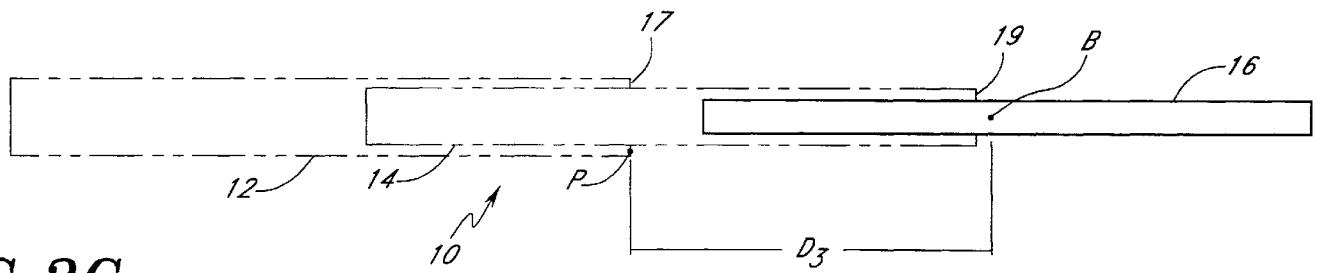

FIGS. 2*a*–2*c* illustrate several distinct relative positions of the slide segments 12, 14, 16 as the slide assembly 10 is extended. With reference to FIG. 2*a,* the point A illustrates the horizontal center point of the inner slide segment 16 when the slide assembly 10 is in a fully closed position. The point A corresponds with the horizontal location of a resultant vertical load force due to an object that is centrally mounted to the inner slide segment 16 and generally corresponds with the center points of the outer and intermediate segments 12, 14.

The point B represents the horizontal location of this resultant force when the inner slide segment 16 fully extends with respect to the intermediate slide segment 14 before the intermediate segment 14 moves from a fully closed position. FIG. 2*a* illustrates the point B when the inner slide segment 16 is fully extended and the intermediate slide segment 14 is in a fully closed position with respect to the outer slide segment 12. In this position, the point B is desirably located proximate the open end 17 of the outer slide segment 12. Preferably, the point B is substantially aligned with the open end 17. However, the location of points A, B, and C in FIGS. 2*a*–3*c* are provided for the purpose of illustration. The actual location of the center of gravity is determined by the object being supported by the inner slide segment 16 and may be located at any position along the length of the inner slide segment 16. As illustrated in FIG. 2*a,* a horizontal distance D1 is defined between the point B and a point P located on the outer slide segment 12. The point P corresponds with the point of contact between the outer slide segment 12 and the individual bearing of the outer bearing assembly 48 (FIG. 4) nearest the open end 17 of the outer slide segment 12. Extension of the inner slide segment 16 beyond the illustrated position results in movement of the intermediate segment 14.

Figure 1:
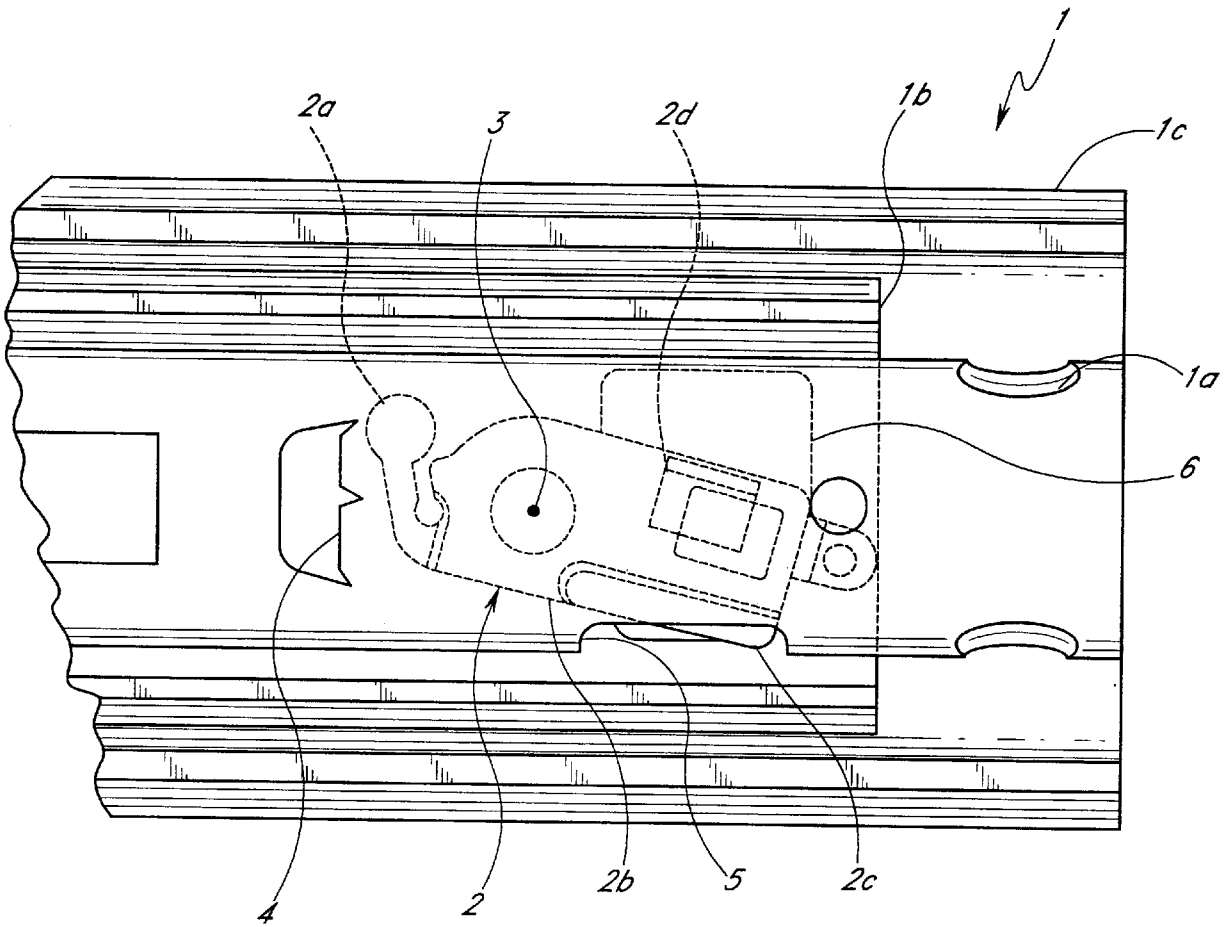
FIG. 1 (PRIOR ART)
FIG. 1 is a partial side elevational view of a prior art slide sequencing latch assembly.

FIG. 2*b* illustrates the slide assembly 10 of FIG. 2*a,* where the intermediate segment 14 is partially extended with respect to the outer segment 12. A horizontal distance D2 is defined between the resultant force point B and the point P. The distance D2 is greater than the distance D1 of the condition illustrated in FIG. 2*b*. Thus, the resulting load on the point P is greater in FIG. 2*b* than in FIG. 2*a*. In addition, the intermediate segment 14 has moved with respect to the outer segment 12 from the position of FIG. 1*a*. Due to the outer bearing assembly 48 being in contact with the intermediate and outer slide segments, 14, 12, the point P has moved nearer to the open end 17 of the outer slide segment 2.

FIG. 2*c* illustrates the slide assembly 10 in a fully extended position. A horizontal distance D3 is defined between the point B and the point P, which is greater than the distance D2. Therefore, the resulting load on the point P is greater than in FIG. 2*b*. The intermediate slide segment 14 and the point P have also moved closer to the open end 17 of the outer slide segment 12 from the position illustrated in FIG. 2*b*.

As the intermediate slide segment 14 is extended with respect to the outer slide segment 12, the distance between the points P and B increases from a distance D1 to a distance D3, thereby increasing the load on the point P. In addition, the point P has moved with respect to the outer slide segment 12. This condition results in an undesirable dynamic load being placed on the outer slide segment 12 at the point P. As defined herein, dynamic loading refers to movement of the intermediate slide segment 14, and thus point P, relative to the outer slide segment 12 simultaneously with an increase in the distance between P and B (e.g., from D1 to D3). Such a dynamic loading of the outer slide segment 12 results in premature wear and/or deformation of the outer slide segment 12, which may in turn cause failure of the slide assembly 10.

Figure 3A:
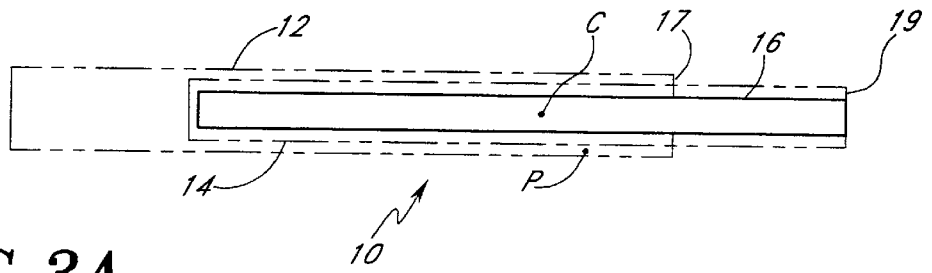
FIGS. 3*a*–3*c* are schematic views of the load on a slide assembly when the intermediate and inner segments are extended as a unit.
Figure 3B:
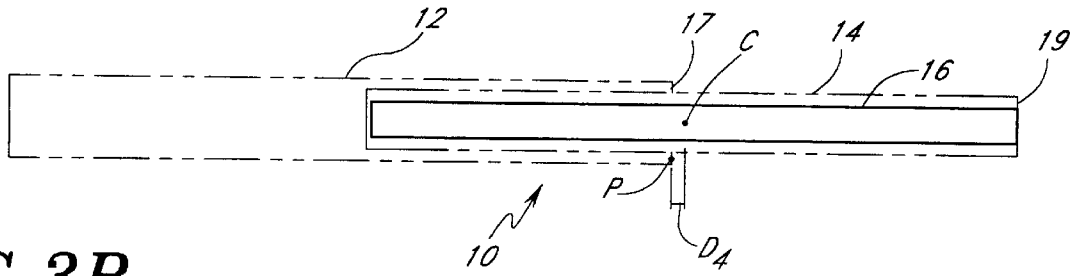
Figure 3C:
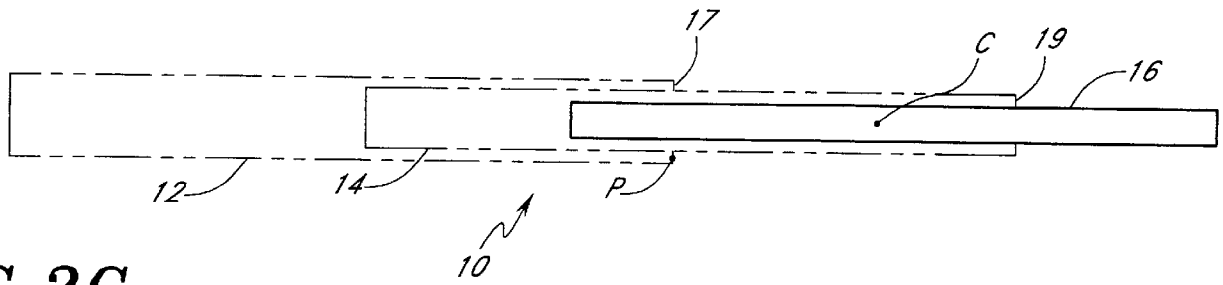

FIGS. 3*a*–3*c* illustrate a preferred sequencing of the extension of the slide assembly 10. In FIGS. 3*a*–3*c,* the intermediate slide segment 14 and the inner slide segment 16 extend from the outer side segment 12 as a unit until the intermediate slide segment 14 reaches full extension (FIG. 3*b*). Only when the intermediate slide segment 14 reaches full extension is the inner slide segment 16 able to extend with respect to the intermediate slide segment 14.

The point C illustrates the horizontal position of a resultant vertical load object being centrally mounted to the slide assembly 10. As illustrated in FIGS. 3*a* and 3*b,* the point C (and thus the resultant load of the object carried by the slide assembly 10) is positioned within the outer slide member 12 for most of the extension of the intermediate slide segment 14. This allows the load to be distributed more evenly across the outer bearing assembly 48 (FIG. 4) positioned between the intermediate slide segment 14 and the outer slide segment 12.

The point C may move slightly beyond the outer slide segment 12 during extension of the intermediate slide segment 14 to a distance equal to the distance D4, illustrated in FIG. 2*a*. However, this distance is relatively small, or may be zero, and does not result in a substantial loading on the point P. As the inner slide segment 14 then extends, the intermediate segment 12, and point P, remains stationary. Thus, no dynamic loading occurs at point P during extension of the inner slide segment 16. In addition, the point C is positioned within the intermediate slide segment 12 for most of the extension of the inner slide segment 14 thereby distributing the load over the inner bearing assembly 50 positioned between the inner slide segment 16 and the intermediate slide segment 14. The sequencing illustrated in FIGS. 3*a*–3*c* results in a much longer life of the slide assembly in comparison to the condition illustrated in FIG. 1. A similar sequencing arrangement is also desirable for friction slide assemblies.

Figure 4:
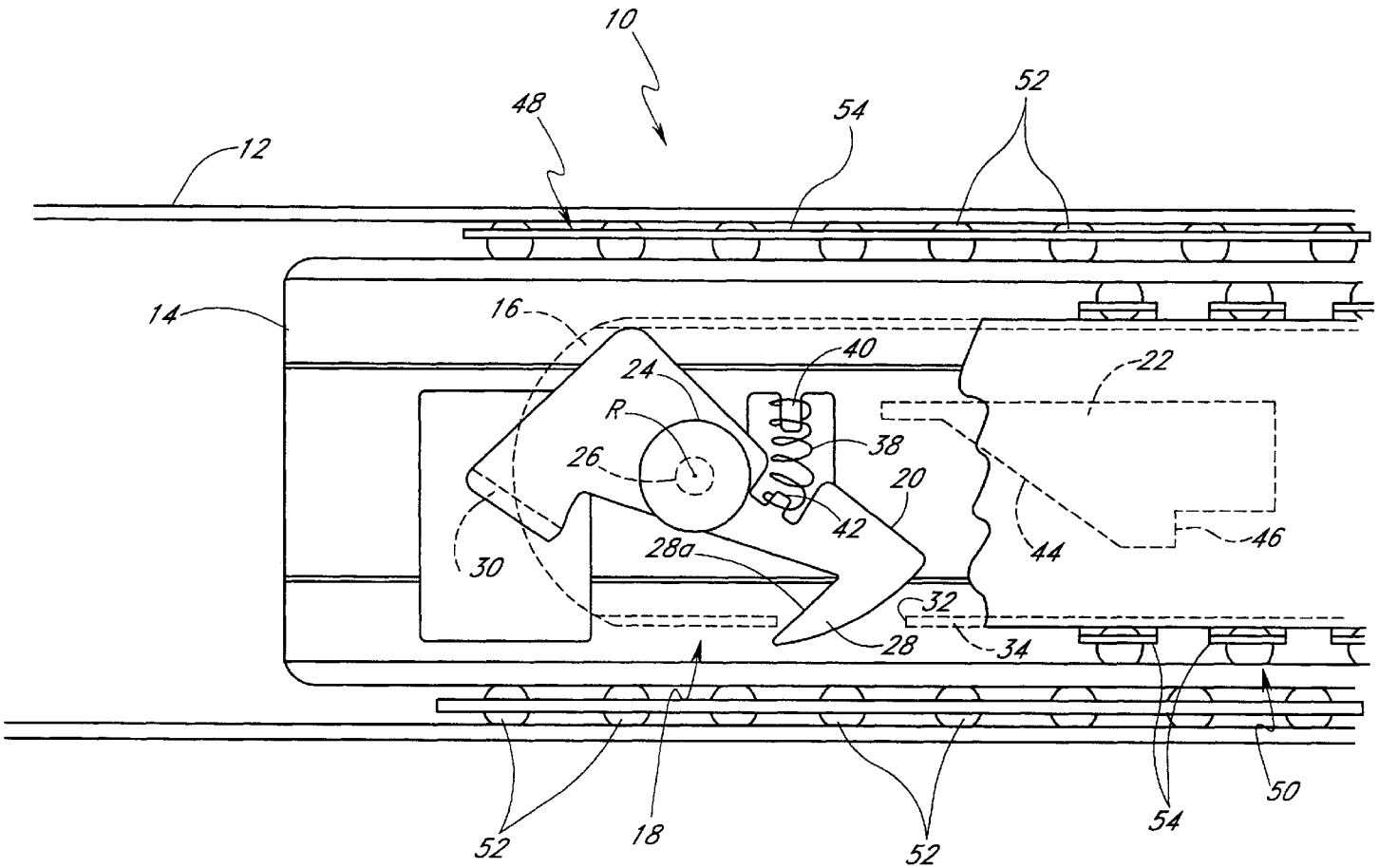
FIG. 4 is an enlarged side view of a slide assembly including a preferred sequencing mechanism.

FIG. 4 illustrates a slide sequencing mechanism 18 which ensures that the intermediate slide segment 14 and the inner slide segment 16 extend as a unit until the intermediate segment 14 substantially reaches its fully extended position. FIG. 4 is a close up view of a slide assembly 10 in a partially extended position. The inner slide segment 16 is illustrated in phantom.

The sequencing mechanism 18 is primarily comprised of a sequence latch 20 pivotally connected to the intermediate slide segment 14 and an actuator 22 connected to, or formed from, the outer slide segment 12. In the illustrated embodiment, the sequence latch 20 is pivotally connected to the intermediate slide segment 14 by a rivet 24. The shaft portion of the rivet 26 defines the axis of rotation R of the sequence latch 20. However, other suitable arrangements of pivotally supporting the latch 20 to the intermediate segment 14 may also be utilized.

The sequence latch 20 includes a hook or latch portion 28 at one end and a transversely, or laterally, extending tab portion 30 at the opposing end. The hook portion 28 of the sequence latch 20 is configured to selectively engage an opening 32 defined by a transverse flange 34 of the inner slide segment 16. The tab portion 30 of the sequence latch 20 extends transversely to the body of the sequence latch 20 through a window 36 defined by the intermediate slide segment 14. Preferably, the tab portion 30 extends a sufficient distance to interact with the actuator 22, as is described in greater detail below. The window 36 preferably is sized to provide clearance for the tab portion 30 as the sequence latch 20 pivots about the rivet shaft 26.

A biasing member 38 exerts a biasing force on the sequence latch 20 tending to rotate the latch 20 in a clockwise direction (in reference to the orientation shown in FIGS. 4–7) about the axis of rotation R. In the illustrated embodiment, the biasing member comprises a coil spring 38 extending between a spring retainer 40 on the intermediate slide segment 14 and a spring retainer 42 provided on the sequence latch 20. Thus, the spring 38 tends to rotate the sequence latch 20 away from the spring retainer 40 such that the hook portion 28 moves toward the transverse flange 34 of the inner slide segment 16.

Advantageously, the spring 38 is functionally positioned between the intermediate slide segment 14 and the latch 20. That is, a first end of the spring 38 applies a force to the intermediate slide segment 16 and a second end of the spring 38 applies an opposing force to the latch 20. Accordingly, the spring 38 influences rotation of the latch 20 at all times, despite the relative positions of the individual slide segments 12, 14, 16. As is described in greater detail below, this permits the latch 20 to be used for multiple sequencing functions. Although a linear coil spring is illustrated, other types of biasing members may also be uses, such as a leaf spring or torsion spring, for example.

Preferably, the actuator 22 includes a ramp surface 44 and a stop surface 46. The ramp surface 44 is configured to engage the tab portion 30 of the sequence latch 20 as the intermediate slide segment 14 moves in extension past the actuator 22 and rotate the latch 20 to withdraw the hook portion 28 of the latch 20 from the opening 32 of the inner segment 16, as is described in greater detail below. The stop surface 46 is configured to engage the tab portion 30 of the sequence latch 20 to lock the intermediate slide segment 14 in a fully extended position.

The slide assembly 10 is illustrated in FIG. 4 with the inner slide segment 16 slightly extended with respect to the intermediate segment 14. With additional reference to FIG. 8, two sets of roller bearings are interposed between the various slide segments of the slide assembly 10. An outer bearing set 48 is positioned between the outer slide segment 12 and the intermediate slide segment 14. An inner bearing set 50 is interposed between the intermediate slide segment 14 and the inner slide segment 16. Each of the bearing assemblies 48, 50 include both an upper and lower plurality of ball bearings 52. The individual bearings 52 are held in a fixed, spaced position relative to one another by a bearing cage 54. The bearing cage 54 also serves to support the bearings 52 in a vertical direction, preferably in contact with bearing races of the outer or intermediate slide segments 12, 14, as is well known in the art. Although such an arrangement is desired, preferred embodiments of the sequencing arrangement may be used with other types of slide assemblies, such as a friction slide assembly, for example.

With reference to FIGS. 4–7, the operation of the sequencing arrangement is described in greater detail. At a position where the inner slide segment 16 has extended with respect to the intermediate slide segment 14 an appropriate distance, the spring 38 biases the sequence latch 20 such that the hook portion 28 engages the opening 32 of the inner slide segment 16. An inner surface of the hook portion 28 defines a retaining surface 28*a*, which contacts a rearward end of the opening 32. Thus, the inner slide segment 16 and the intermediate slide segment 14 are connected so that they extend together as a unit.

Desirably, the latch 20 locks the inner slide segment 16 to the intermediate slide segment 14 before the inner slide segment 16 has extended one-third of its total extension travel with respect to the intermediate slide segment 14. Preferably, the latch 20 locks the inner slide segment 16 to the intermediate slide segment 14 before the inner slide segment 16 has extended one-fifth of its total extension travel with respect to the intermediate slide segment 14 and more preferably before the inner slide segment 16 has extended one-tenth of its total extension travel with respect to the intermediate slide segment 14.

For example, in a slide assembly 10 in which each of the slide segments 12, 14, 16 are approximately 28 inches in length, the inner slide segment 16 is preferably capable of extending approximately 15 inches with respect to the intermediate slide segment 14. Accordingly, the latch 20 desirably locks the inner slide segment 16 to the intermediate slide segment 14 before the inner slide segment 16 has extended approximately 5 inches. Preferably, the latch 20 locks the inner slide segment 16 to the intermediate slide segment 14 before the inner slide segment 16 has extended 3 inches with respect to the intermediate slide segment 14 and more preferably before the inner slide segment 16 has extended 1.5 inches with respect to the intermediate slide segment 14.

Figure 5:
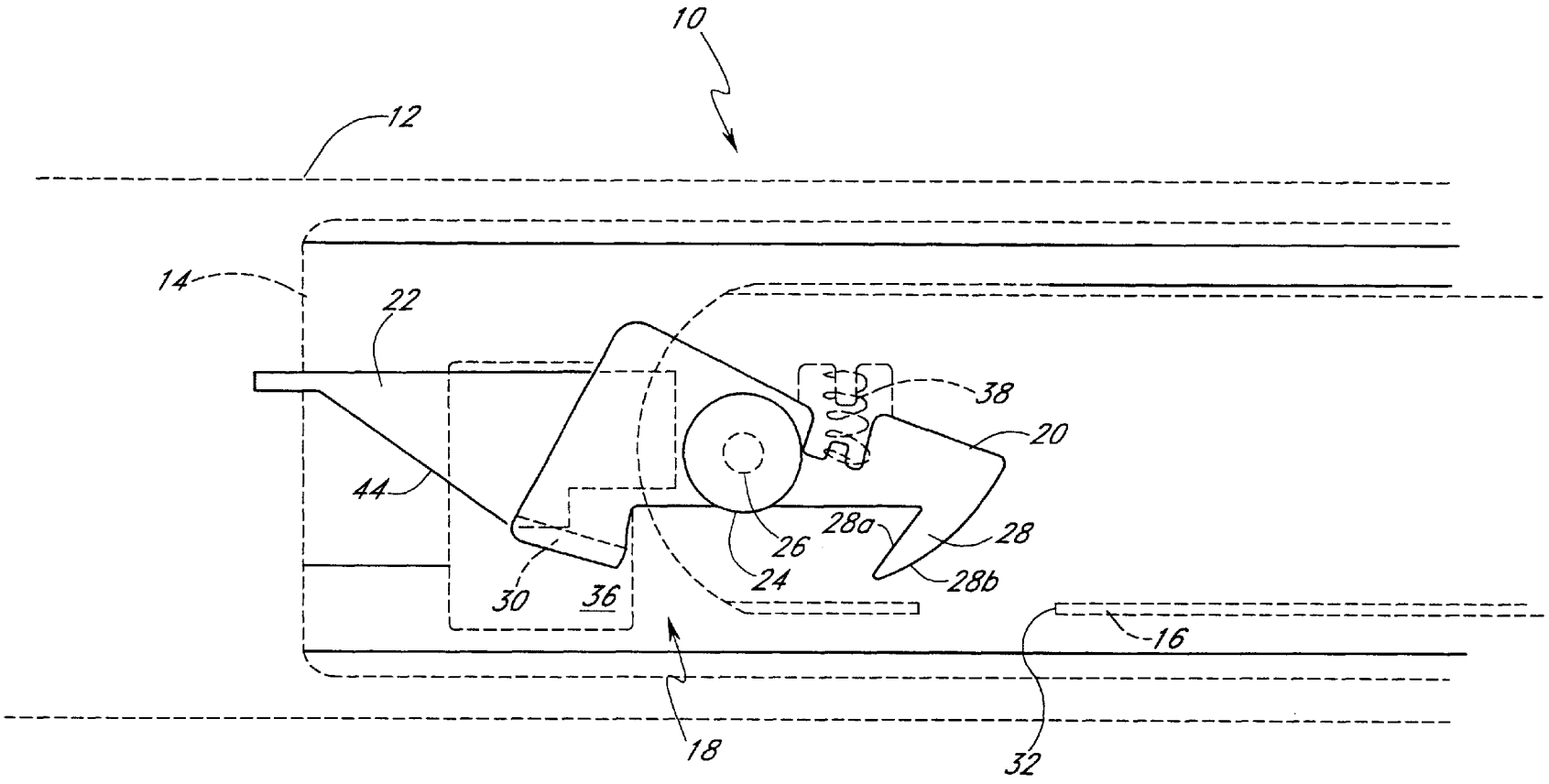
FIG. 5 is a side view of a sequencing mechanism of FIG. 4 in an unlocked position. Portions of the slide segments are shown in phantom.

As illustrated in FIG. 5, as the intermediate slide segment 14 nears its fully extended position the tab portion 30 of the sequence latch 20 engages the ramp surface 44 of the actuator 22. As the intermediate slide segment 14 continues in extension, movement of the tab portion 30 along the ramp surface 44 causes the hook portion 28 of the sequence latch 20 to be withdrawn from the opening 32 of the inner slide segment 16. Thus, the inner slide segment 16 is allowed to extend with respect to the intermediate slide segment 14.

Figure 6:
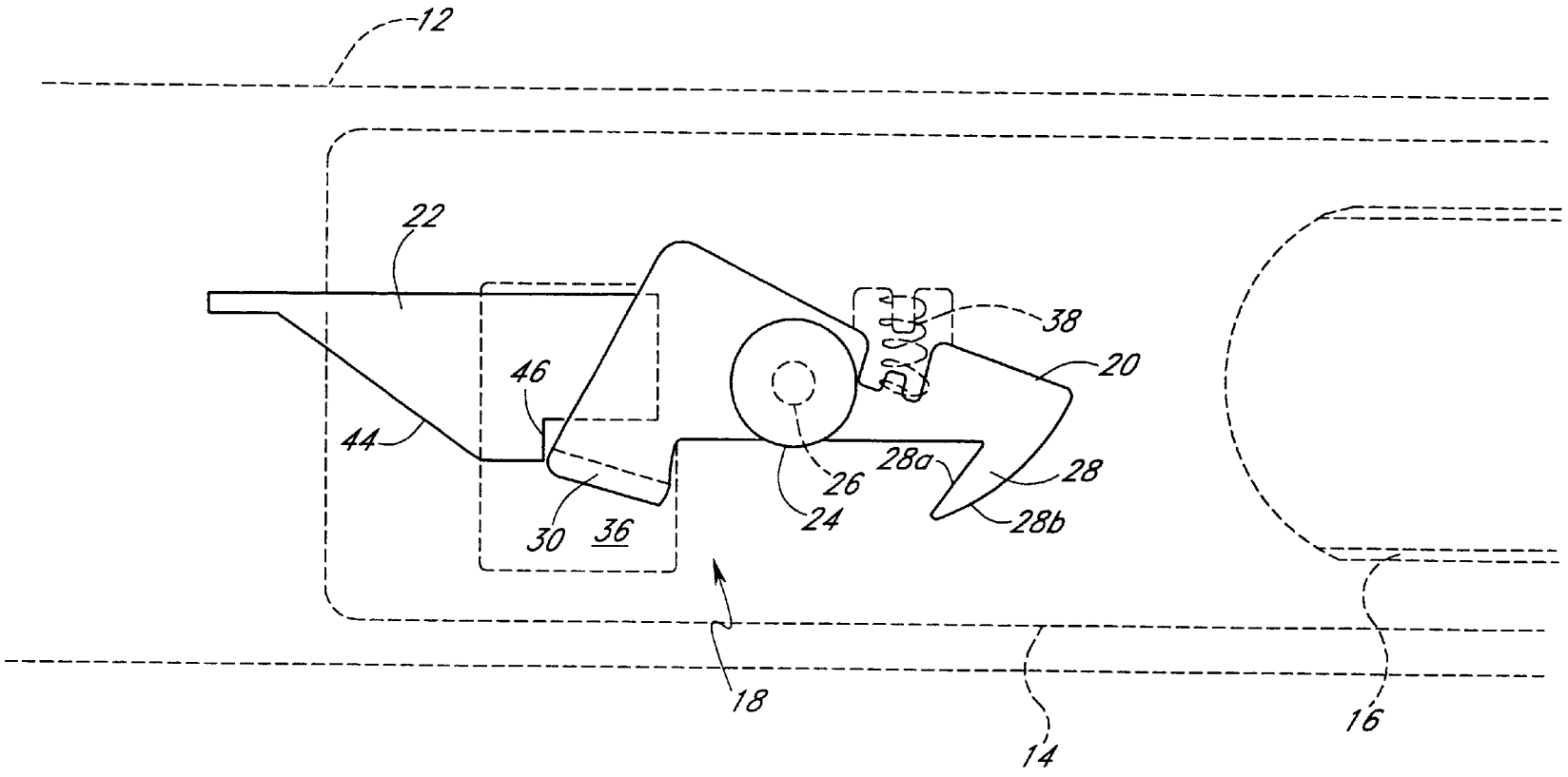
FIG. 6 is a side view of the sequencing mechanism of FIG. 4 in a fully extended locked position.

With reference to FIG. 6, once the sequence latch 20 passes the ramp surface 44 of the actuator 22, it is biased by the spring 38 into contact with the stop surface 46. The engagement of the tab portion 30 with the stop surface 46 prevents the retraction of the intermediate slide segment 14 with respect to the outer slide segment 12. Thus, the intermediate slide segment 14 is locked in a fully extended position. Advantageously, the illustrated sequencing assembly 18 positions the latch 20 into contact with the stop surface 46, despite the relative position of the inner slide segment 16 with the intermediate slide segment 14. Accordingly, the intermediate segment 14 may be secured in an extended position even when the slide assembly 10 is in an inverted orientation.

Figure 7:
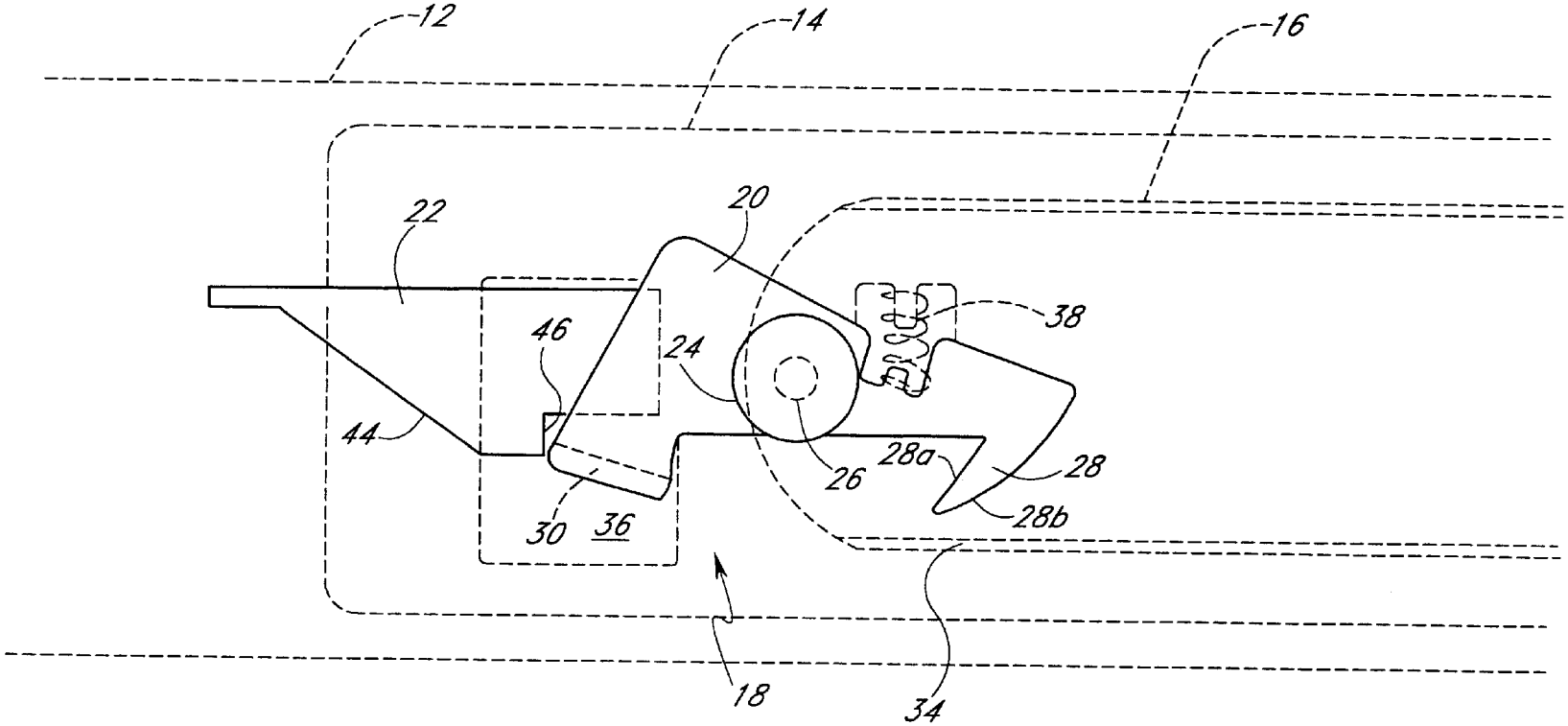
FIG. 7 is a side view of the sequencing assembly of FIG. 4 when being released from the fully extended locked position.

With reference to FIG. 7, as the inner slide segment 16 is moved in a retraction motion, the flange 34 engages an outer, or release, surface 28*b* of the hook portion 28 of the sequence latch 20. As the inner slide segment 16 continues with retraction motion, interaction of the transverse flange 34 with the hook portion 28 causes the sequence latch 20 to rotate about the pivot axis R. This rotation causes the tab portion 30 of the sequence latch 20 to disengage from the stop surface 46 of the actuator 22, thereby allowing the intermediate slide segment 14 to be moved in retraction motion relative to the outer slide segment 12. Rotation of the latch 20 occurs smoothly due to the curved shape of the release surface 28*b*. Furthermore, use of the hook portion 28 of the latch 20 for both retention of the inner slide segment 16 and release of the intermediate slide segment 14, as described immediately above, eliminates the need for additional actuation member(s) to release the intermediate segment 14 from its locked position. Advantageously, this feature allows the sequencing assembly 18 to be manufactured with an efficient use of material and, thereby, with a lower overall cost.

In an alternative arrangement, the inner slide segment 16 may be completely removed from the intermediate slide segment 14. In this instance, the sequence latch 20 may be provided with a portion suitable to allow manual disengagement of the latch 20 from the stop surface 46 thereby allowing the intermediate slide segment 14 to retract with respect to the outer slide segment 12.

FIG. 8 is a cross-section view of the slide assembly of FIG. 4 illustrating the relative positions of the slide segments 12, 14, 16 and bearing assemblies 48, 50. Desirably, each of the slide segments 12, 14, 16 comprise a unitary piece of material and include appropriate surface configurations to engage one, or both, of the bearing assemblies 48, 50. This permits the slide assembly 10 to be manufactured in a cost-effective manner. However, other suitable slide segment shapes and arrangements may also be utilized.

Advantageously, due to its being spring-biased, the sequencing mechanism 18 illustrated herein is capable of operating without the assistance of gravity. This allows a single slide construction to be used on opposing sides of a drawer or other object, without modification. To be used on each side of an object, the opposing slides must be rotated 180° about a longitudinal axis with respect to one another so that each of the outer slide segments 12 are positioned away from the drawer, toward the enclosure or other support structure. As is known, a gravity assisted mechanism is not capable of operating properly in both orientations.

The illustrated sequencing arrangement 18 overcomes the drawbacks of the prior art, including those of the Parvin sequence latch described above. As is explained in detail in the present specification, the provision of a biasing member functionally positioned between the intermediate segment 14 and the latch 20 permits the latch 20 to be used for multiple sequencing functions in both an upright orientation and an inverted orientation of the slide assembly 10. As also explained above, the Parvin sequence latch relies on contact between the spring arm 2*a* of the latch 2 and the tab 4 of the inner slide segment 1*a*. Accordingly, the Parvin latch only functions independently of gravity when the inner slide segment 1*a* is fully retracted relative to the intermediate slide segment 1*b*. Therefore, the Parvin latch is not capable of providing reliable, additional sequence functions, such as locking of the intermediate segment 1*b* in an extended position, when the slide assembly is in an inverted orientation.

Furthermore, in order to provide reliable coupling of the inner 1*a* and intermediate 1*b* slide segments for extension, the relative size and positioning of the tab 4, latch 2 and opening 5 are critical. Providing such critical size and positioning of the various components greatly increases manufacturing costs and reduces the reliability of the slide assembly 1. For example, if the tab 4 is damaged (or otherwise displaced), during manufacture, transport, or use, the sequencing latch 2 may fail to operate properly, at least in an inverted orientation of the slide assembly 1. Preferred embodiments of the present sequencing arrangement, as described above, are arranged to provide reliable operation and long life, without relying on highly critical dimensions that increase manufacturing costs and reduce reliability.

Although the present invention has been described in the context of a preferred embodiment, it is not intended to limit the invention to the provided example. Modifications to the sequencing mechanism that are apparent to one of skill in the art are considered to be part of the present invention. Accordingly, the invention should be defined solely by the appended claims in light of the teachings of the disclosure.

What is claimed is:

1. A slide assembly, comprising:

an outer slide segment;

an intermediate slide segment telescopingly engaged with said outer slide segment and moveable between a retracted position and an extended position with respect to said outer slide segment;

an inner slide segment telescopingly engaged with said intermediate slide segment and moveable between a retracted position and an extended position with respect to said intermediate slide segment;

a sequencing latch pivotally connected to said intermediate slide segment;

a spring member having a first end and a second end, said spring member being configured to exert opposing forces from said first and second ends, said first end of said spring member acting on said intermediate slide segment and said second end of said spring member acting on said latch, thereby biasing said latch into mechanical engagement with said inner slide segment to lock said inner slide segment substantially in said retracted position with respect to said intermediate slide segment when said intermediate slide segment is in said retracted position;

an actuator fixed with respect to said outer slide segment and including a ramp surface being configured to engage said latch when said intermediate slide segment is substantially in said extended position, wherein further extension of said intermediate segment causes said latch to rotate and release said inner slide segment from said retracted position.

2. The slide assembly of claim 1, wherein said actuator additionally comprises a stop surface, said spring biasing said latch into engagement with said stop surface to secure said intermediate slide segment into said extended position.

3. The slide assembly of claim 2, wherein a portion of said inner slide segment is configured to engage said latch during retraction of said inner slide segment to bias said latch out of engagement with said stop surface and thereby permit retraction of said intermediate slide segment.

4. The slide assembly of claim 3, wherein said portion of said inner slide comprises a transverse flange portion defining a contact surface.

5. The slide assembly of claim 3, wherein said latch includes a hook portion, an inner surface of said hook portion defining a retaining surface, said inner slide segment including a transverse flange portion defining an opening, said retaining surface being configured to engage said opening to lock said inner slide portion in said retracted position.

6. The slide assembly of claim 5, wherein an outer surface of said hook portion defines a release surface, said portion of said inner slide segment being configured to contact said release surface during retraction of said inner slide segment to bias said latch out of engagement with said stop surface and thereby permit retraction of said intermediate slide segment.

7. A slide assembly, comprising:

an outer slide segment;

an intermediate slide segment telescopingly engaged with said outer slide segment and moveable between a retracted position and an extended position with respect to said outer slide segment;

an inner slide segment telescopingly engaged with said intermediate slide segment and moveable between a retracted position and an extended position with respect to said intermediate slide segment;

a sequencing latch connected to said intermediate slide segment, said latch having a first end defining a retaining surface and a release surface, the retaining surface being configured to lock said inner slide segment substantially in said retracted position with respect to said intermediate slide segment when said intermediate slide segment is in said retracted position;

an actuator fixed with respect to said outer slide segment and being configured to engage said latch to release said inner slide segment from said retracted position when said intermediate slide segment is substantially in said extended position, said actuator additionally comprising a stop surface, said latch being configured to engage said stop surface to secure said intermediate slide segment into said extended position; and wherein a portion of said inner slide segment is configured to engage said release surface of said latch during retraction of said inner slide segment to bias said latch out of engagement with said stop surface and thereby permit retraction of said intermediate slide segment.

8. The slide assembly of claim 7, wherein said portion of said inner slide comprises a transverse flange portion defining a contact surface.

9. A slide assembly, comprising:

an outer slide segment;

an intermediate slide segment telescopingly engaged with said outer slide segment and moveable between a retracted position and an extended position with respect to said outer slide segment;

an inner slide segment having at least one transverse flange defining an opening, said inner slide segment telescopingly engaged with said intermediate slide segment and moveable between a retracted position and an extended position with respect to said intermediate slide segment;

a sequencing latch connected to said intermediate slide segment;

a spring member arranged to apply opposing forces on said intermediate slide segment and said latch, said spring biasing a portion of said latch within said opening to lock said inner slide segment substantially in said retracted position with respect to said intermediate slide when said intermediate slide is in said retracted position;

an actuator fixed with respect to said outer slide segment and being configured to engage said latch, wherein further extension of said intermediate slide segment rotates said latch to release said inner slide segment from said retracted position when said intermediate slide segment is substantially in said extended position.

10. The slide assembly of claim 9, wherein said sequencing latch is pivotally connected to said intermediate segment.

11. The slide assembly of claim 9, wherein said actuator additionally comprises a stop surface, said spring biasing said latch into engagement with said stop surface to secure said intermediate slide segment into said extended position.

12. The slide assembly of claim 11, wherein a portion of said inner slide segment is configured to engage said latch during retraction of said inner slide segment to bias said latch out of engagement with said stop surface and thereby permit retraction of said intermediate slide segment.

13. The slide assembly of claim 12, wherein said portion of said inner slide comprises said transverse flange.

14. The slide assembly of claim 12, wherein said latch includes a hook portion, an inner surface of said hook portion defining a retaining surface, said transverse flange defining an opening, said retaining surface being configured to engage said opening to lock said inner slide portion in said retracted position.

15. The slide assembly of claim 14, wherein an outer surface of said hook portion defines a release surface, said portion of said inner slide segment being configured to contact said release surface during retraction of said inner slide segment to bias said latch out of engagement with said stop surface and thereby permit retraction of said intermediate slide segment.

* * * * *